US006113846A

United States Patent [19]

Honkura et al.

[11] Patent Number: 6,113,846

[45] Date of Patent: Sep. 5, 2000

[54] PRODUCTION APPARATUS FOR RARE EARTH ANISOTROPIC MAGNET POWDERS

[75] Inventors: Yoshinobu Honkura, Chita-gun; Takenobu Yoshimatsu, Tokai; Mitsuyuki Maeda; Kouji Murata, both of Chita-gun; Chisato Mishima, Chita, all of Japan

[73] Assignee: Aichi Steel Works, Ltd., Tokai, Japan

[21] Appl. No.: 09/212,860

[22] Filed: Dec. 17, 1998

[30] Foreign Application Priority Data

Dec. 22, 1997 [JP] Japan ..... 9-353897

[51] Int. Cl.[7] ..... C21D 1/06

[52] U.S. Cl. ..... 266/257; 266/252

[58] Field of Search ..... 266/249, 252, 266/257; 432/14, 152; 148/122, 101, 105

[56] References Cited

U.S. PATENT DOCUMENTS

| | | | |
|---|---|---|---|
| 4,981,532 | 1/1991 | Takeshita et al. . | |
| 5,044,613 | 9/1991 | Kumar et al. | 266/170 |
| 5,127,970 | 7/1992 | Kim . | |
| 5,143,560 | 9/1992 | Doser . | |
| 5,338,371 | 8/1994 | Nakayama et al. . | |
| 5,354,040 | 10/1994 | Nakayama et al. . | |
| 5,580,396 | 12/1996 | Fruchart et al. . | |
| 5,609,695 | 3/1997 | Kojima et al. . | |
| 5,851,312 | 12/1998 | Honkura et al. | 148/122 |

FOREIGN PATENT DOCUMENTS

| | | |
|---|---|---|
| 0 411 571 | 2/1991 | European Pat. Off. . |
| 0 516 264 | 12/1992 | European Pat. Off. . |
| 0 545 644 | 6/1993 | European Pat. Off. . |
| 0 546 799 | 6/1993 | European Pat. Off. . |
| 0 633 582 | 1/1995 | European Pat. Off. . |
| 2 387 500 | 11/1978 | France . |
| 5-163510 | 6/1993 | Japan . |
| 5-171203 | 7/1993 | Japan . |
| 5-171204 | 7/1993 | Japan . |
| 5-247528 | 9/1993 | Japan . |
| 9-251912 | 9/1997 | Japan . |
| 2 094 961 | 9/1982 | United Kingdom . |
| 2 194 029 | 2/1988 | United Kingdom . |
| 2 258 468 | 2/1993 | United Kingdom . |
| 2 263 969 | 8/1993 | United Kingdom . |
| 2 310 432 | 8/1997 | United Kingdom . |

*Primary Examiner*—Scott Kastler

*Attorney, Agent, or Firm*—Jacobson, Price, Holman & Stern, PLLC

[57] ABSTRACT

An apparatus that gives continuous hydrogen heat treatment to anisotropic rare earth magnet powders is invented. The apparatus a comprises shopper 12, a furnace 11 to carry out a hydrogen heat treatment, a heat compensating means 14 that is placed in the heating room of the furnace to keep the treatment temperature constant, a movable stopper 15 to support the material in the heating room of the furnace 11 and a cooling container 18. The raw magnet powder is fed into the furnace 11 and supported by the stopper 15, then hydrogen heat treatment is carried out. After the treatment the stopper opens the bottom end of the heating room and the processed magnet powder falls into the cooling room. By the operation described above, the present apparatus can carry out continuous hydrogen heat treatment without stopping the heating of the furnace batch by batch. Continuous hydrogen heat treatment greatly improves the production efficiency and quality of the processed magnet powder.

6 Claims, 3 Drawing Sheets

PRODUCTION APPARATUS FOR RARE EARTH ANISOTROPIC MAGNET POWDERS

BACKGROUND OF THE INVENTION

1. Field of the Invention

The present invention relates to a production apparatus for producing anisotropic rare earth magnet powder by applying hydrogen heat treatment which induces hydrogenation and hydrogen desorption in rare earth magnet material.

2. Description of the Related Art

Recently the rare earth anisotropic magnet powders are increasingly used in bonded magnets, mainly due to their good magnetic properties such as high maximum energy product ((BH) max ), high residual magnetic flux density (Br) and high intrinsic coersivity (iHc). Among various producing methods of the rare earth magnet powders with good magnetic properties, it is known that the hydrogen heat treatment is quite effective. The hydrogen heat treatment consists of the hydrogenation process in which the raw magnet powder is kept at 750° C.–950° C. in hydrogen atmosphere to make the powder absorb hydrogen and subsequent hydrogen desorption process in which the powder is compelled to release the hydrogen in vacuum. By applying hydrogen heat treatment, iHc is enhanced because of refinement of the grain, and Br is improved by an alignment of the grain orientation in the material.

The above mentioned hydrogen heat treatment, however, has a drawback that the method is not suitable to mass production. It is because the required temperature control of the material is too severe to attain by the conventional technology in a large scale production.

In the hydrogen heat treatment, the small deviation of treatment temperature from the desired value either in the hydrogenation process or in the hydrogen desorption process causes significant deterioration of the magnetic properties of the obtained magnet powder. Therefore it is required that the temperature is controlled precisely in the whole material in both processes. However, there is a formidable problem to keep the temperature constant. The reaction between the magnet powder and hydrogen is a self exciting reaction, the hydrogenation being exothermic reaction and the hydrogen desorption being endothermic reaction. The heat generated in the reactions is proportional to the material mass. The heat tends to make the treatment temperature deviate from a desired range. So it is difficult to keep the temperature in a desired range in mass production.

We solved this problem by inventing a production method and an apparatus for hydrogen heat treatment that is disclosed in Japanese Patent Application Laid-open (Kokai) No.9-251912. The invented apparatus is characterized by sets of a processing vessel and a heat compensating vessel in contact. The heat generated by the exothermic reaction during hydrogenation process or by the exothermic reaction during hydrogen desorption process is compensated by the counter reaction of heat generating material contained in the heat compensating vessel. As a result, the treatment temperature of the hydrogen heat treatment can be easily controlled within a desired treatment temperature range. The controllability of the method is independent of the production scale so that mass production by the hydrogen heat treatment can be set into practice.

However the invented apparatus had three major drawbacks because it utilized a batch-type furnace. The first drawback is poor time efficiency for the treatment. The second is the oxidization of the powder. The third is inhomogeneity in the processed powder.

The poor time efficiency mainly comes from the following two reasons. One is the need of heating and cooling time of the furnace. The heating from room temperature to the treatment temperature and the cooling from treatment temperature to the room temperature takes certain time for each processing batch. The second is the handling time for feeding the powder material in the apparatus and taking them out. The handling requires special care. When feeding the raw material into the furnace, the powder must be distributed well in the processing vessel to assure the sufficient contact area with the heat compensating vessel for the precise temperature control. The effective feeding method in the interlaced structure of processing vessel and heat compensating vessel was not established in the above invention, so the feeding requires long time. When taking the processed material out of the furnace, the powder is usually aggregated to lumps and need to be crushed before taking them out. It also requires long time.

The second drawback is that the material may be oxidized during feeding of the raw magnet powder or taking out the processed magnet powder because processing room of the furnace is exposed to the ambient atmosphere.

The third drawback, the inhomogeneity of the processed powder, is brought about during the heating and cooling steps of the furnace. The heating and cooling of the material is done by heat transfer between the processing vessel and the material. Because the degree of the heat transfer is different in the position in the processing vessel, the temperature inhomogeneity takes place in the material. This temperature inhomogeneity brings about the magnetic property inhomogeneity.

SUMMARY OF THE INVENTION

It is the object of the present invention to provide a production apparatus which can solve the above problems. Since the problems come from the nature of batch-processing, so continuous hydrogen heat treatment is offered in the invented apparatus to solve the problems. By applying continuous hydrogen heat treatment, time efficiency is improved, and oxidization and inhomogeneity can be avoided. The invented apparatus also offers a compact construction.

The apparatus comprises a furnace for the hydrogen heat treatment, a heat compensating means that is placed in a heating room of the furnace, a movable stopper to support a material in a space formed between a wall of the heating room of the furnace and the heat compensating means, a driving equipment for the movable support, a hydrogen supply system, and an evacuation system. The furnace has an inlet for the raw magnet powder on its one end and an outlet for the processed magnet powder on the other end. The heating room in which the hydrogen heat treatment is carried out is in the middle part between the inlet and the outlet. The heat compensating means is made of a vessel containing a material which can generate and absorb the heat such as hydrogen absorbing alloys. The heat generated/absorbed by the heat compensating means is controlled to cancel out the heat absorbed/generated by the processed material during the hydrogen heat treatment. If the material contained in the heat compensating means is a hydrogen absorbing alloys, the heat compensating means must have a hydrogen pressure adjusting equipment to control the hydrogen pressure inside the vessel. The stopper is movable and shuttle between two positions. At one position the stopper seals the space formed by the wall of heating room of the furnace and the heat compensating means, and at the other position the stopper opens the space and let the material move out of the heating room. The stopper movement is controlled by the stopper driving equipment. The hydrogen supply system supplies the hydrogen gas into the furnace at a desired hydrogen partial pressure.

In the present invention of a production apparatus, it is favorable to add a hopper of the raw magnet powder and a cooling container for the processed magnet powder to the apparatus, placing them in vertical arrangement. Thus the raw magnet powder comes out from the hopper and goes into the furnace through the inlet by the aid of gravity, and after the hydrogen heat treatment the processed magnet powder comes out of the heating room of the furnace and goes into the cooling container also by the aid of gravity.

It is also favorable to place a powder scattering equipment at the bottom of said hopper or at the top of said heating room to let the powder fall uniformly from the hopper to the heating room. In addition, it is more favorable that the stopper has a crushing equipment that makes up-and-down movement to crush the aggregated powder according to the movement of the stopper.

The kinds of raw material used in the present invention are R-T-boron type magnet or R-T-M type magnet, wherein R stands for rare earth element such as Y, La, Ce, Pr, Nd, Sm, Gd, Tb, Dy, Ho, Er, Tm, Lu; T stands for ferrous metal such as Fe, Co, Ni; and M stands for element which forms tetragonal ThMn12 type compounds such as Ti, V, Cr, Mo. More than 50% of R must be Nd or Pr or sum of both, also more than 50% of T must be Fe.

Examples of the magnet used in this invention are Nd—Fe—B type, Nd—Fe—Ga—Nb—B type magnet.

The procedure of the hydrogen heat treatment using the invented apparatus, in which a hopper, the furnace and the cooling container are arranged in a vertical configuration, is as follows.

At first the temperature of the heating room of the furnace is elevated to a set temperature. The stopper is set in the upper position to seal the heating room. Then the raw magnet powder is fed through the inlet of the furnace. The raw magnet powder is kept in the heating room of the furnace by support of the stopper. Then hydrogen gas is introduced into the heating room from the hydrogen supply system at a set hydrogen pressure. The magnet powder is kept in the hydrogen gas for a set time to have the hydrogenation process, then the hydrogen gas is evacuated from the furnace to have the hydrogen desorption process.

By the above hydrogen heat treatment, the magnetic properties of the powder is enhanced. Heat compensation means functions to cancel out the heat generated/absorbed by the reaction between the magnet powder and hydrogen during the hydrogenation process/hydrogen desorption process, thus keeping the reaction temperature to a desired preciseness to give excellent magnet properties.

After the hydrogen heat treatment, we move the stopper to the lower position by the stopper driving equipment. The space between the inner wall of the heating room of the furnace and the outer wall of the heat compensating means is opened, and the processed magnet powder falls into the cooling container. The processed magnet powder is cooled to room temperature, and the powder is either taken out of the cooling container, or is transferred to the next process. During these operations, the temperature of the furnace is kept to the fixed treatment temperature. After the processed magnet powder goes out of the heating room, we move a stopper to upper position by driving equipment and again make the space sealed by the stopper. Then the next batch of raw magnet powder is fed into the heating room from the inlet, and the second round of the hydrogen heat treatment is carried out. By the operation descried so far, the present apparatus can carry out continuous hydrogen heat treatment without stopping the heating of the furnace batch by batch.

The advantages offered by the present invented apparatus are as follows.

First, the magnetic properties of the rare earth anisotropic magnet powders is greatly improved even though the production scale is enlarged, because the hydrogen heat treatment is carried out within a precise temperature range.

Second, present invention offers greatly improved time efficiency. The improvement is given by three reasons. One is that the apparatus can give a continuous hydrogen heat treatment from one batch to next batch without heating/cooling time of the furnace. Another reason is that it does not require cumbersome feeding or taking out of the material. In a vertical configuration of the hopper, the furnace, and the cooling container, the feeding and taking out the powder is very easy with the aid of the gravity. The other reason for the improved time efficiency is that the heating time for the powder is considerably shortened. In the batch type furnace, the heating must be done for the whole system including the powder, the processing vessel and the heat compensating vessel. On the contrary, the present invented apparatus, only the powder is required to be heated. The heat capacity of the powder itself is significantly small compared to the whole system.

The third advantage of the present invention is that it prevents the oxidization of the powder. It is because the heating room is completely separated from the ambient atmosphere, so that the oxidization of the powder by the outer air is completely avoided. The separation also prevents leak of the hydrogen gas from heating room to the outside of the apparatus.

The fourth advantage is that the properties of the processed magnet powder is homogeneous because the furnace temperature is always kept in a fixed one and temperature distribution in the powder is homogeneous.

When the vertical configuration is adopted, there is one more advantage in the present invention. In the configuration, the apparatus has simple and compact construction. When the parts of the apparatus are placed in a vertical configuration, the powders moves by the aid of gravity and there is no need for the special transfer system for the material. The raw magnet powder falls from the hopper into the heating room, then it is supported by the stopper and given the hydrogen heat treatment, then falls into the cooling container by setting the stopper to lower position.

As is described before, by placing a powder scattering equipment either at the bottom of said hopper or at the top of said heating room, it can be possible to let the powder fall uniformly from the hopper to the heating room. It improves the uniformity of the magnet properties of the powder after the hydrogen heat treatment.

In addition, it is favorable that the stopper has a crushing equipment that makes up-and-down movement to crush the aggregated powder according to the movement of the stopper. After the crushing, the powder is transferred to the cooling container.

In the present invention of a production apparatus, it is possible to make the whole process of the hydrogen heat treatment completely continuous. For the purpose, as described before, it is favorable to add a hopper of the raw magnet powder and a cooling container for the processed magnet powder to the apparatus, arranging them in vertical configuration. Thus the raw magnet powder comes out from the hopper and goes into the furnace through the inlet by the aid of gravity, and after the hydrogen heat treatment the processed magnet powder comes out of the heating room of the furnace and goes into the cooling container also by the aid of gravity. Thus the whole process the comprising feeding of raw magnet powder, the hydrogen heat treatment, cooling, and taking out the processed magnet powder can be done continuously.

BRIEF DESCRIPTION OF THE DRAWINGS

FIG. 2(*b*) is a schematic view of opened tubular space formed between an inner wall of a heating room and a heat compensating means.

DETAILED DESCRIPTION OF THE PREFERRED EMBODIMENT (Production apparatus 1)

Figure 1:
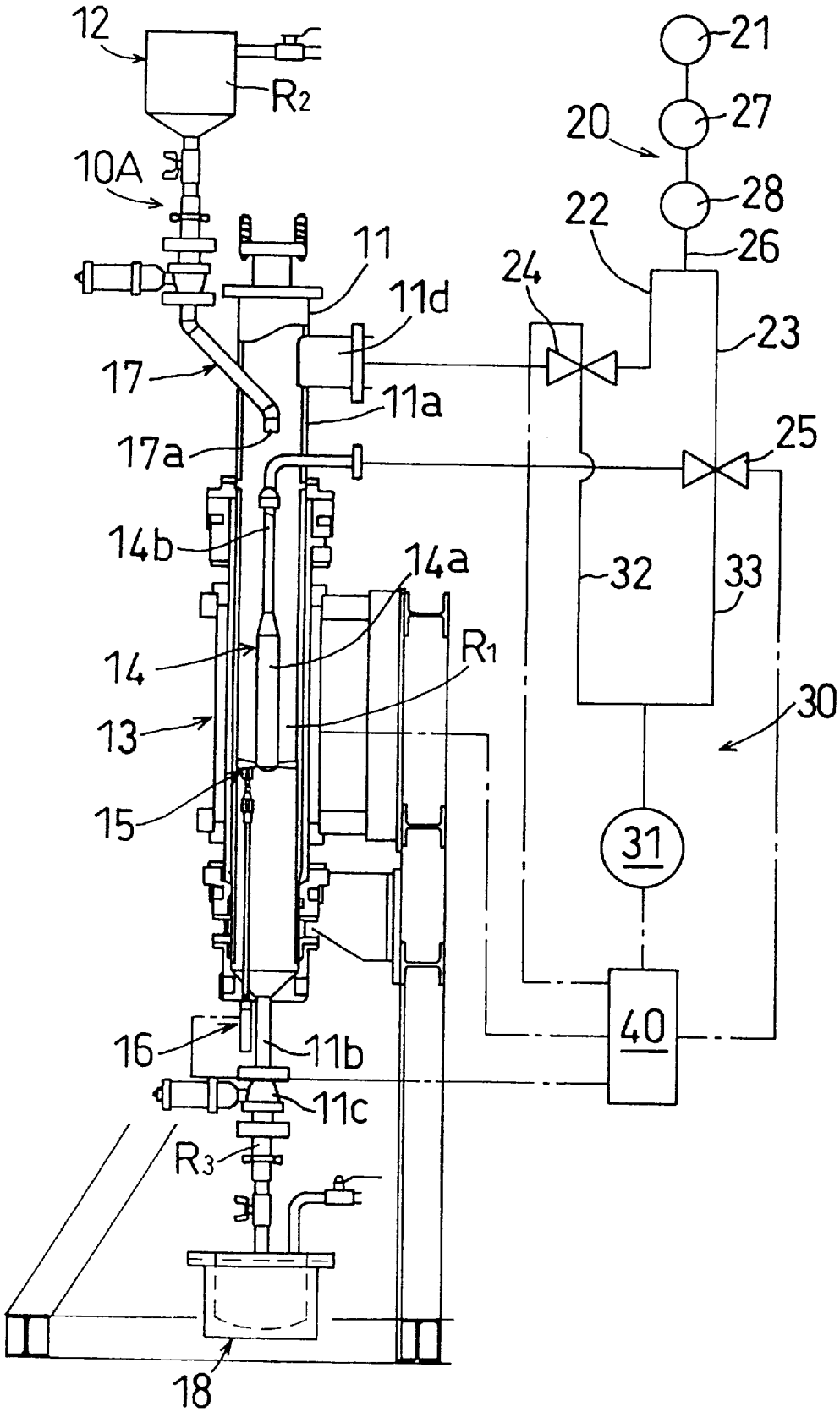
FIG. 1 is a schematic illustration of a production apparatus 1 in an embodiment.

An example of the present invention of a production apparatus for producing rare earth magnet powders is shown in FIG. 1.

The present apparatus comprises a furnace system 10A, a hydrogen supply system 20, an evacuation system 30 and a control system 40.

The furnace system 10A includes a furnace proper 11, a raw magnet powder hopper 12, a heating system 13, a compensating means 14, a stopper 15 and a stopper driving equipment 16.

The furnace proper 11 is made of stainless steel tube of a proper length and diameter, comprising an upper cylinder 11*a* and a lower cylinder 11*b* and hermetically sealed from ambient atmosphere. The hopper 12 is connected to the furnace 11 at the top of the upper cylinder 11*a* through a raw magnet powder supply line 17. The end of the supply line 17 that is inserted in the furnace proper 11 has an open end.

The hopper 12 is a storage container of the raw magnet powder. The raw magnet powder supply line 17 is to feed the raw magnet powder from the hopper 12 to the furnace proper 11.

In the furnace proper 11, the lower end of the cylinder 11*b* is connected with cooling container 18 through the gate valve 11*c*. The heating system 13 is a cylindrical electrothermic heating coil around the middle part of the furnace proper 11, and it is capable to heat furnace proper 11 up to about 1000° C.

In the furnace system 10A, the heating zone of the furnace proper 11 corresponds to the foregoing heating room. Also, an opening 17*a* of the supply line 17 and the lower opening of the lower cylinder 11*b* in the furnace proper 11 correspond to the foregoing inlet and outlet of the furnace, respectively.

The heat compensating means 14 is made of stainless steel tube of a proper length with hermetic seal. It consists of a heat compensating material container 14*a* and a connecting pipe 14*b*. The heat compensating means 14 is placed in the heating room of the furnace proper 11 concentrically with the furnace proper 11. The connecting pipe 14*b* is penetrate through the inner wall of the furnace proper 11 gas-tight, and it is connected to the external hydrogen supply system and evacuation system. In the container 14*a* the heat compensating material which is the same kind of material as the processed magnet powder is contained.

Figure 2B:
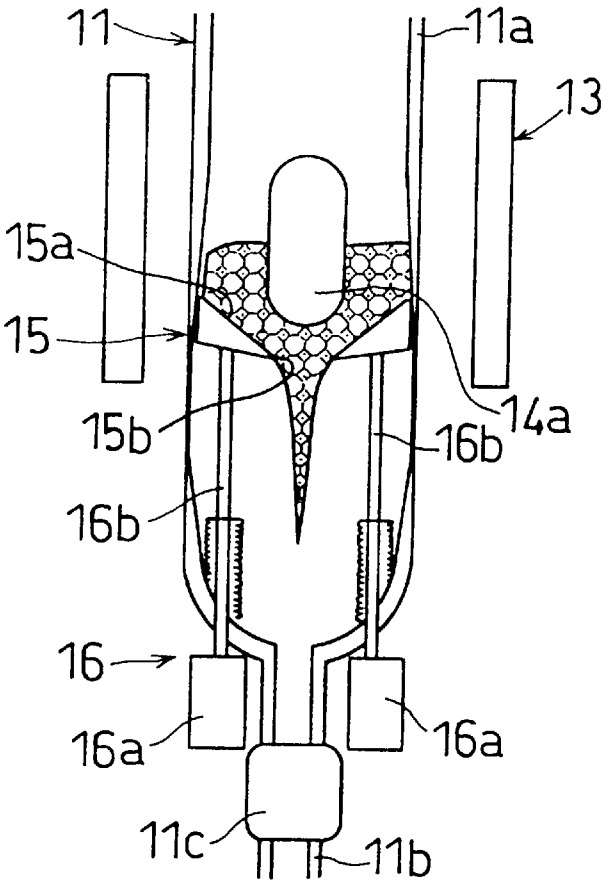
FIG. 2(*a*) is a schematic view of sealed tubular space formed between an inner wall of a heating room and a heat compensating means.
Figure 2A:
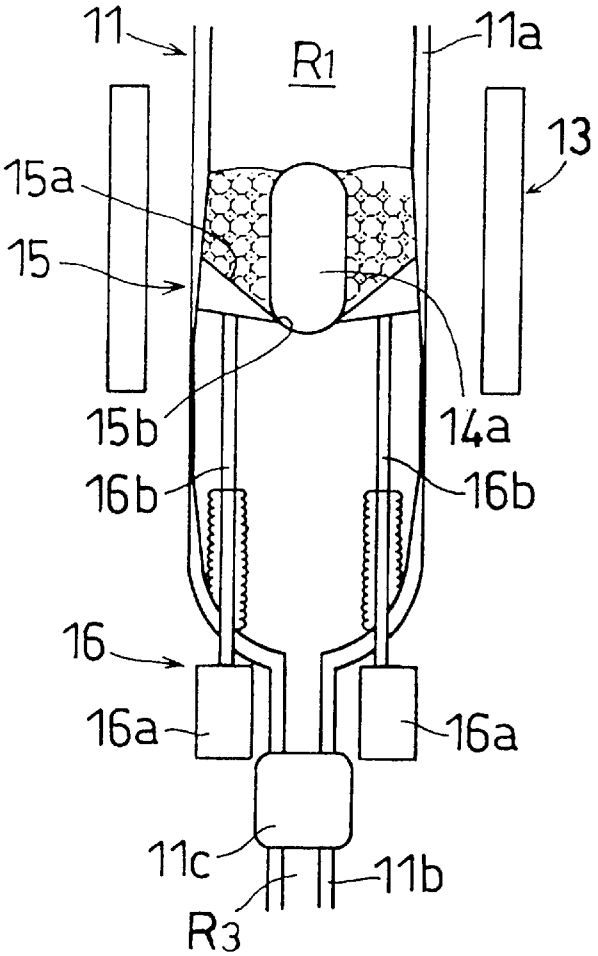

The stopper 15 that is seen in FIGS. 1 and 2 has a circular shape, and it can be moved upward or downward in the furnace proper 11. An upper surface 15*a* of the stopper 15 is concave, having a center hole 15*b* in the middle. The stopper 15 is arranged under the heat compensating means 14 in the furnace proper 11, and supported by the stopper driving equipment 16.

The stopper driving equipment 16 comprises multiple air cylinders, each air cylinder consisting a cylinder 16a and a piston rod 16*b*. The cylinders 16*a* are placed in the periphery of the lower end of the cylinder 11*a* of the furnace proper 11, and the piston rod 16*b* is connected the bottom of the stopper 15 through the bottom the furnace proper 11 gas-tight, and can be moved upward and downward.

In this way, the stopper 15 can be moved upward and downward by the driving equipment 16.

When the stopper 15 is located on the upper limit, as shown in FIG. 2(*a*), it can keep the magnet powder in the heating room by sealing the tubular space formed by the inner wall of the heating room and outer wall of the heat compensation means by the hole 15*b* fitting in the bottom 14*a*. When the stopper 15 is located on the lower limit, as shown in FIG. 2(*b*), the magnet powder falls through the gap between the hole 15*b* and the bottom of the container 14*a* of the heat compensating means 14 into the cooling container.

The hydrogen supply system 20 comprises a hydrogen cylinder 21, a first supply pipe 22 that connects a pipe 11*d* in the furnace proper 11 and a hydrogen cylinder 21, and a second supply pipe 23 that connects the pipe 14*b* of the heat compensating means 14 and hydrogen cylinder 21, a first three-way switching valve 24 in the supply pipe 22, a second three-way switching valve 25 in the supply pipe 23, a hydrogen refinery equipment 27 in a common part 26 of the supply pipe 22 and 23, and an accumulator 28 of the hydrogen.

An evacuation system 30 comprises a vacuum pump 31, a first evacuation pipe 32 that connects the first switching valve 24 and the vacuum pump 31, and a second evacuation pipe 33 that connects the second switching valve 25 and vacuum pump 31. The switching valves 24 and 25 are used commonly in both the hydrogen supply system 20 and the evacuation system 30.

A control system 40 controls the heating system 13, the stopper driving equipment 16, the vacuum pump 31, and the switching valves 24 and 25. The function of the control system 40 is as follows. First the control system 40 maintains the temperature in the heating room within a fixed treatment temperature by controlling the heating system 13. Then the system sets the position of the stopper 15 to keep the powder in the heating room for a set time. At the same time it control the hydrogen pressure or evacuation pressure in the heating room and the heat compensating means by supplying hydrogen gas or evacuating hydrogen by activating the switching valve 24 and 25. After the hydrogen heat treatment is completed, the control system lowers the stopper and let the processed magnet powder fall into the cooling container.

(Hydrogen Heat Treatment)

An example of the alloy suitable for the treatment in the present apparatus is Nd—Ga—Nb—B—Fe type alloy with a chemical composition of Nd12.5at %, Ga0.3at %, Nb0.2at %, B6.2at % and balanced with Fe with inevitable impurities. The alloy is melted into an ingot. Then it is crushed into coarse grain with the diameter of 2–4 mm by preliminary hydrogenation and desorption process at 250° C.

Before starting the treatment, each part of the apparatus is set to the following state. In the heat compensating material the container 14*a* of the heat compensating means 14, the same material as processed one is placed. The stopper 15 is located on its lower limit. The first supply pipe 22 is disconnected from the common part 26 of the hydrogen supply system 20 and at the same time it is connected to the first evacuation pipe 32. The second supply pipe 23 is connected to the common part 26 of the hydrogen supply system 20 and at the same time it is disconnected from the second evacuation pipe 33.

The treatment is started as the following manner. The heating system 13 and the vacuum pump 31 is activated. After the compensating means 14 is evacuated to a vacuum of 10-4torr, hydrogen gas is supplied from the hydrogen cylinder 21 and hydrogen pressure in the heat compensating means 14 is controlled to a set pressure. The heating room of the furnace proper 11 is heated to a set temperature, for example 800° C. Then the stopper 15 is shifted to the upper position to make a tubular space for the hydrogen heat treatment.

Then, the switching valves 24 and 25 are operated so that the first supply pipe 22 is connected to the common part 26 of the hydrogen supply system 20 and at the same time it is disconnected from the first evacuation pipe 32. Also the second supply pipe 23 is disconnected from the common part 26 of the hydrogen supply system 20 and at the same time it is connected to the second evacuation pipe 33. The raw magnet powder is fed into the heating room through the raw magnet powder supply line 17, and supported by the stopper 15.

By above operation, hydrogen gas is introduced into the heating room of the furnace 11 and the hydrogen heat treatment is carried out.

This hydrogenation process, which is exothermic reaction, is accompanied by heat generation. The hydrogenation process is carried out for 6 hours at about 820° C. at a pressure of 0.2–0.6 atm. To cancel out the heat generation with the hydrogenation, the heat compensating material container 14*a* of the heat compensating means 14 is evacuated to a vacuum by vacuum pump 31. As a result the material in 14*a* absorbs heat because of the hydrogen desorption process, which is endothermic reaction, is induced.

The hydrogen desorption process is induced in a vacuum of 10-1~10-5 torr. By the counter reaction in the heat compensating means 14, the heat generated by the processed magnet powder in the heating room is canceled. As a result, the heat treatment temperature in the heating room is maintained at about 820° C.

After the hydrogenation process is completed, the hydrogen desorption process is started.

To evacuate the furnace 11, the switching valves 24 and 25 are operated so that the first supply pipe 22 is disconnected from the common part 26 of the hydrogen supply system 20 and at the same time it is connected to the first evacuation pipe 32. Also the second supply pipe 23 is connected to the common part 26 of the hydrogen supply system 20 and at the same time it is disconnected from the second evacuation pipe 33.

As a result, the inside of the furnace 11 is evacuated and the hydrogen desorption process of the magnet powder supported on the stopper 15 is carried out.

This hydrogen desorption process, which is endothermic reaction, is accompanied by heat absorption. The hydrogen desorption process is carried out for 60 minutes at 820° C. at a pressure of 10-1–10-5 torr. To cancel out the heat absorption with the hydrogen desorption, the heat compensating material container 14*a* of the heat compensating means 14 is supplied with hydrogen gas. As a result the material in 14*a* generates heat because of the hydrogenation process, which is exothermic reaction, is induced.

By the counter reaction in the heat compensating means 14, the heat absorbed by the processed magnet powder in the heating room is canceled. Because of this cancellation, the heat treatment temperature in the heating room is maintained at about 820° C. The hydrogenation in the heat compensating material container 14*a* is carried out at 820° C. for 60 minutes at a pressure of 0.2–0.6 atm.

After the hydrogen heat treatment is completed, the switching valve 24 and 25 is set to the neutral point. Then the stopper 15 is set to the lower position by the stopper driving equipment 16 so that the processed magnet powder, namely rare earth anisotropic magnet power, falls down through the hole 15*b* of the stopper 15 into the cooling container 18.

After one round of the hydrogen heat treatment is completed as just described above, each part of the apparatus is set to the initial state for next hydrogenation process. The switching valves 24 and 25 are operated so that the first supply pipe 22 is connected to the common part 26 of the hydrogen supply system 20 and at the same time it is disconnected from the first evacuation pipe 32. Also the second supply pipe 23 is disconnected from the common part 26 of the hydrogen supply system 20 and at the same time it is connected to the second evacuation pipe 33. The stopper 15 is set to its upper position to support the raw magnet powder in the heating room of the furnace 11.

Thereafter, hydrogen gas is introduced from the hydrogen cylinder 21 to the furnace 11. The heat compensation material container 14*a* is evacuated by the vacuum pump 31. The raw material is fed from the hopper 12 to the furnace 11 through the raw magnet supply line 17.

According to the present invention, the magnetic properties of the rare earth anisotropic magnet powders is greatly improved by the application of the hydrogen heat treatment that is carried out within precise temperature range. Present invention also offers greatly improved time efficiency, because the apparatus can give a continuous hydrogen heat treatment.

It means the present invented apparatus can save the operating time compared to the batch type furnace. As a result a production efficiency of present apparatus is improved. Furthermore, the oxidization of the powder is avoided and the properties of the processed magnet powder is homogeneous.

Another advantage of the present invention is that the apparatus can be designed in simple and compact construction. If the parts of the apparatus is arranged in a vertical configuration so that the powders moves by the aid of gravity and there is no need for the special transfer system for the material.

(Production apparatus 2)

Figure 3:
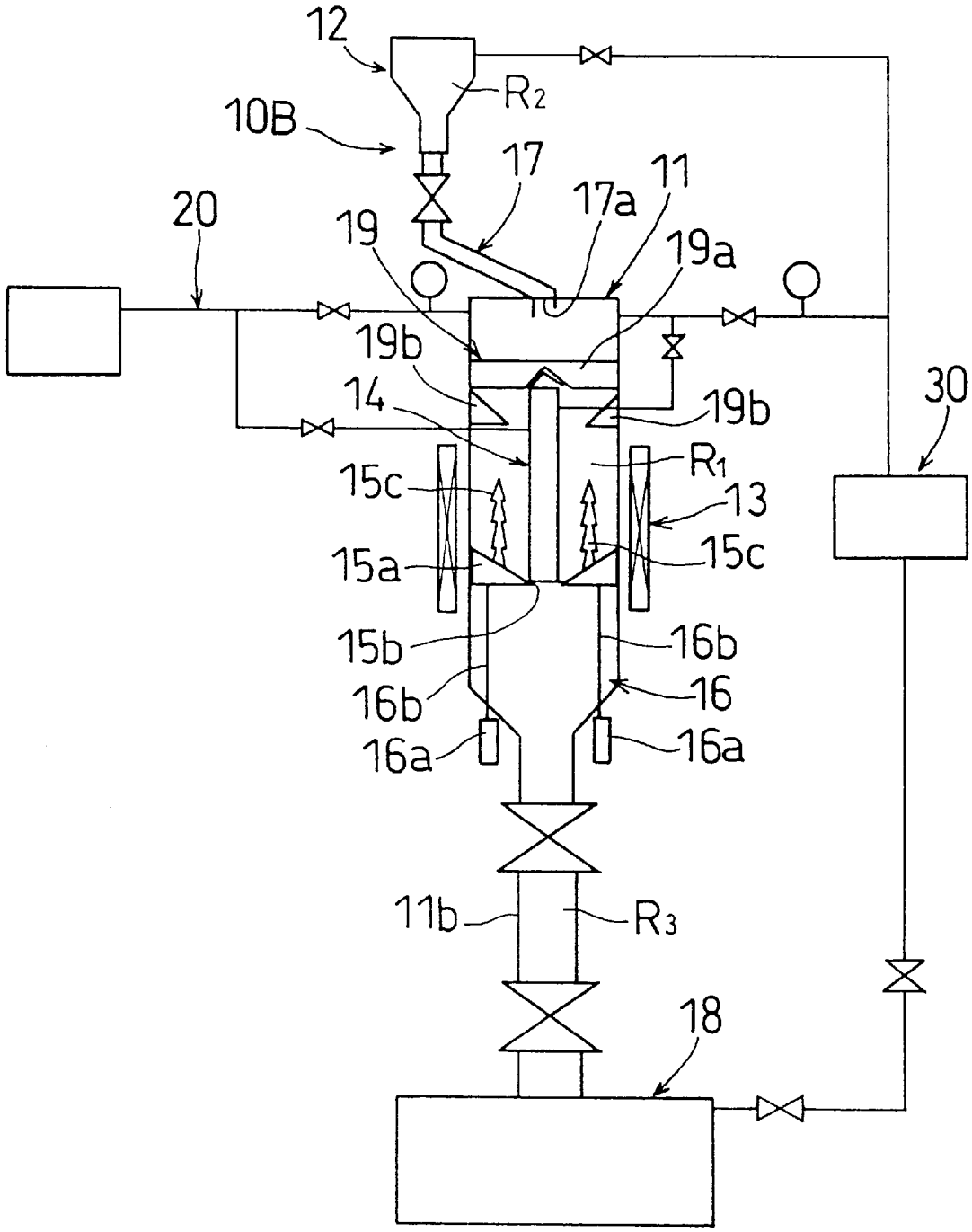
FIG. 3 is a schematic illustration of a production apparatus 2 in an embodiment.

Another example of the production apparatus according to the present invention is shown schematically in FIG.3.

The present production apparatus 2 has similar structure as the producing apparatus 1. It comprises a furnace system 10B, a hydrogen supply system 20 and an evacuation system 30 and a control system which is not shown in the Figure. Each part is similar to that of the apparatus 1 except for the furnace system 10B.

Detailed description is omitted for the parts that are similar to those of the apparatus 1. Those similar parts are indicated as the same symbols as in the apparatus 1. Hereafter the different constitution and function of the furnace system 10B compared to the furnace system 10A is described.

The furnace system 10B comprises a furnace proper 11, a hopper 12, a heating system 13, a heat compensating means 14, a stopper 15, a stopper driving equipment 16, a raw material supply line 17 and a processed powder container. There is a heating room RI in the upper part of the furnace proper 11, and a raw magnet powder container R2 in the hopper 12. In addition to above mentioned parts, the furnace system 10B has a powder crushing equipment 15*c* and a powder scattering equipment 19 to let the powder fall uniformly from the hopper to the heating room. The powder crushing equipment 15*c* and the powder scattering equipment 19 is the difference of furnace system 10B from the furnace system 10A.

The powder crushing equipment 15*c* is plurality of awl-like part with proper length placed on the upper surface 15*a* of the stopper 15.

It moves up and down with the stopper driving system 16 moves. The crushing equipment 15*c* is to crush the agglomerated powder into coarse grains by its up-and-down motion, and helps the processed magnet powder to fall down through the hole 15*b* into the cooling room.

The powder scattering equipment 19 is located above the heating room R1 in the furnace proper 11, and comprises a crossed angle bar 19*a* and a conical part 19*b*. The crossed angle bar 19*a* is fixed inner wall of the furnace proper 11, the conical part 19*b* is placed below the crossed angle bar 19*a*.

In the present producing apparatus, the raw magnet powder is supplied from the hopper 12 through the raw magnet powder supply line 17, and fed to the middle of the top of the furnace 11. The powder goes through the powder scattering equipment 19 and rests on the stopper 15. The powder falls evenly on the upper surface 15*a* of the stopper 15 because it is scattered evenly by the equipment 19 and guided by conical part 19*b*.

The presented apparatus 2 has a vertical configuration of the raw material container R2 in the hopper 12, the heating room R1 in the furnace 11, and a cooling container 18 below the furnace 11. Because of this configuration, the raw magnet powder comes out from the hopper and goes into the furnace through the inlet by the aid of gravity, and after the hydrogen heat treatment the processed magnet powder comes out of the heating room of the furnace and goes into the cooling container also by the aid of gravity. Thus the whole process that comprises feeding raw magnet powder, the hydrogen heat treatment, cooling, and taking out the processed magnet powder can be completely continuous.

Furthermore, the uniformity of the processed magnet powder is enhanced by the effect of the powder scattering equipment 19. The equipment 19 can feed the raw magnet powder quite evenly into the heating room R1 in which the heat compensating means is placed.

Also the present apparatus can crush the aggregated powder into coarse grains by the powder crushing equipment 15*c* on the stopper 15 that gives up-and-down motion, and helps the processed magnet powder to fall down into the cooling container 18.

What is claimed is:

1. An apparatus to produce rare earth anisotropic magnet powders having excellent magnetic properties by applying hydrogen heat treatment comprising;

a furnace having an inlet for raw magnet powder on its one end, an outlet for the processed magnet powder on the other end, and a heating room in which a hydrogen heat treatment is carried out between said inlet and said outlet, a heat compensating means that is placed in said heating room of said furnace concentrically to cancel out the heat generation/absorption of said hydrogen heat treatment by synchronized counter reaction, a movable stopper to support material in a tubular space formed between said heating room of said furnace and said heat compensating means at its one position and to let the processed magnet powder move out of said heating room at its other position, a driving equipment for said movable stopper, a hydrogen supply equipment to supply gas with a set partial pressure of hydrogen to said furnace and said heat compensating means.

2. A producing apparatus for rare earth magnet powders as set forth in claim 1, wherein, said inlet is placed on top of said furnace, said outlet is placed in the bottom of said furnace, said stopper makes up-and-down movement in said furnace in a manner that it supports the material in the tubular space formed between said heating room of said furnace and said heat compensating means at is upper limit and it let the processed magnet powder fall out of said heating room at its lower limit.

3. A producing apparatus for rare earth magnet powders as set forth in claim 1, wherein, said heat compensating means comprises a cylinder containing a hydrogen absorbing material which generates and absorbs the heat by the reaction with hydrogen, and a hydrogen pressure adjusting equipment to control said hydrogen pressure inside said cylinder.

4. A producing apparatus for rare earth magnet powders as set forth in claim 1, wherein, said apparatus has a hopper of the raw magnet powder, said heating room to carry out said hydrogen heat treatment, and a cooling container for the processed magnet powder, placing them in vertical configuration so that the raw magnet powder comes out from said hopper and goes into said furnace through said inlet by the aid of gravity, and after said hydrogen heat treatment the processed magnet powder comes out of said heating room of said furnace and goes into said cooling container also by the aid of gravity.

5. A producing apparatus for rare earth magnet powders as set forth in claim 3, wherein a hopper or said heating room has a raw magnet powder scattering equipment to feed the powder evenly into said heating room.

6. A producing apparatus for rare earth magnet powders as set forth in claim 1, wherein said stopper has a powder crushing equipment to crush the aggregated powder obtained after said hydrogen heat treatment.

* * * * *